US010951977B2

(12) United States Patent
Yanagidate et al.

(10) Patent No.: US 10,951,977 B2
(45) Date of Patent: Mar. 16, 2021

(54) SPEAKER

(71) Applicant: MITSUBISHI ELECTRIC CORPORATION, Chiyoda-ku (JP)

(72) Inventors: Naomichi Yanagidate, Chiyoda-ku (JP); Tsuyoshi Nakada, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/475,309

(22) PCT Filed: Oct. 30, 2017

(86) PCT No.: PCT/JP2017/039176
§ 371 (c)(1),
(2) Date: Jul. 1, 2019

(87) PCT Pub. No.: WO2018/138994
PCT Pub. Date: Aug. 2, 2018

(65) Prior Publication Data

US 2019/0335270 A1 Oct. 31, 2019

(30) Foreign Application Priority Data

Jan. 24, 2017 (JP) ..... JP2017-010606

(51) Int. Cl.
*H04R 1/24* (2006.01)
*H04R 7/12* (2006.01)
*H04R 9/06* (2006.01)

(52) U.S. Cl.
CPC ..... *H04R 1/24* (2013.01); *H04R 7/12* (2013.01); *H04R 9/06* (2013.01)

(58) Field of Classification Search
CPC ... H04R 1/24; H04R 7/12; H04R 7/20; H04R 7/14; H04R 7/125; H04R 7/06; H04R 7/122; G10K 13/00
See application file for complete search history.

(56) References Cited

U.S. PATENT DOCUMENTS 5,418,337 A * 5/1995 Schreiber ..... H04R 7/12 181/171
2006/0008111 A1* 1/2006 Nagaoka ..... H04R 31/003 381/423

FOREIGN PATENT DOCUMENTS

CN 202121764 U * 1/2012
CN 202121764 U 1/2012
(Continued)

OTHER PUBLICATIONS

International Search Report dated Dec. 5, 2017 in PCT/JP2017/039176 filed Oct. 30, 2017.
(Continued)

*Primary Examiner* — Sunita Joshi
(74) *Attorney, Agent, or Firm* — Xsensus LLP

(57) ABSTRACT

A speaker includes a main-cone and a sub-cone. Linear thin portions configured to reduce a plate thickness of the sub-cone are formed on a region containing at least any one of an outer side and an inner side of the sub-cone. Each of the linear thin portions has both of a component in a radial direction and a component in a circumferential direction of the sub-cone. First and second linear thin portions cross each other at an intersection. With this configuration, stiffness of the whole sub-cone is reduced to enhance a divided vibration of the sub-cone. In particular, a vibrational displacement of an outer peripheral portion of the sub-cone, from which a sound is mainly radiated, is increased.

15 Claims, 10 Drawing Sheets

(56) References Cited

FOREIGN PATENT DOCUMENTS

| | | | |
|---|---|---|---|
| JP | 63-108294 | U | 7/1988 |
| JP | 1-57886 | U | 4/1989 |
| JP | 2017-69692 | A | 4/2017 |

OTHER PUBLICATIONS

Chinese Office Action dated Apr. 1, 2020 in Chinese Application No. 201780083887.7.

* cited by examiner

SPEAKER

TECHNICAL FIELD

The present invention relates to a speaker, and more particularly, to a double cone speaker comprising a main-cone and a sub-cone.

BACKGROUND ART

A reproducible frequency band of a cone-type speaker is determined by a diameter of a cone. Therefore, a large-size speaker having a cone diameter of, for example, 10 cm or larger cannot sufficiently reproduce a high-frequency band equal to or higher than 5 kHz in comparison to a low-frequency band.

A double cone speaker is known, in which a sub-cone having a smaller diameter than that of a main-cone is bonded to the main-cone of the speaker. In this manner, the double cone speaker is capable of sufficiently reproducing a sound in a frequency band ranging from the low-frequency band to the high-frequency band. The sub-cone of the double cone speaker radiates a sound through a divided vibration. Therefore, by forming the sub-cone into an easily deformable shape, the reproducible frequency band can be enlarged while an acoustic radiation power can be increased.

In Patent Literature 1, there is described a configuration of a double cone speaker in which a plurality of linear thin portions extending from an outer peripheral portion of a sub-cone toward a central portion are formed. Further, in Patent Literature 2, there is described a configuration in which a wave-shaped corrugation is formed on a sub-cone.

CITATION LIST

Patent Literature

[PTL 1] JPU S63-108294
[PTL 2] JPU H01-57886

SUMMARY OF INVENTION

Technical Problem

In Patent Literature 1, the acoustic radiation power is decreased because of reduction of a radiation area of the sub-cone. Thus, there is a problem in that a sound pressure that is required to compensate for a high-frequency band unreproducible with the main-cone cannot be obtained with the sub-cone.

Further, in Patent Literature 2, the divided vibration is not enhanced because stiffness of the sub-cone is increased by the corrugation. Thus, there is a problem in that a sound pressure that is sufficient to compensate for the high-frequency band unreproducible with the main-cone cannot be obtained with the sub-cone.

The present invention has been made to solve the problems described above, and has an object to provide a speaker capable of enhancing a divided vibration of a sub-cone, to thereby enlarge a reproducible frequency band and increase an acoustic radiation power.

Solution to Problem

According to one embodiment of the present invention, there is provided a speaker, comprising a main-cone and a sub-cone, which are integrally formed, wherein a plurality of linear thin portions are formed on the sub-cone, and the plurality of linear thin portions have an intersection on the sub-cone.

Advantageous Effects of Invention

With the speaker according to one embodiment of the present invention, it is possible to enhance a divided vibration of the sub-cone, to thereby enlarge a reproducible frequency band and increase an acoustic radiation power.

DESCRIPTION OF EMBODIMENTS

Now, details of a speaker according to embodiments of the present invention are described with reference to the accompanying drawings. The embodiments described below are merely examples, and the present invention is not limited to those embodiments.

First Embodiment

Figure 1:
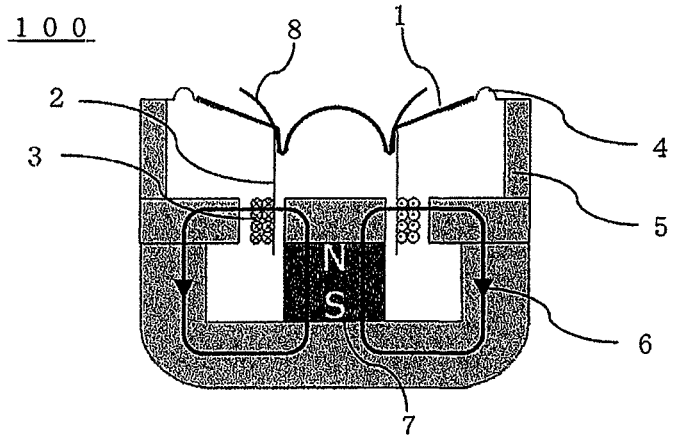
FIG. 1 is a sectional view for illustrating a configuration of a speaker according to a first embodiment.
Figure 2:
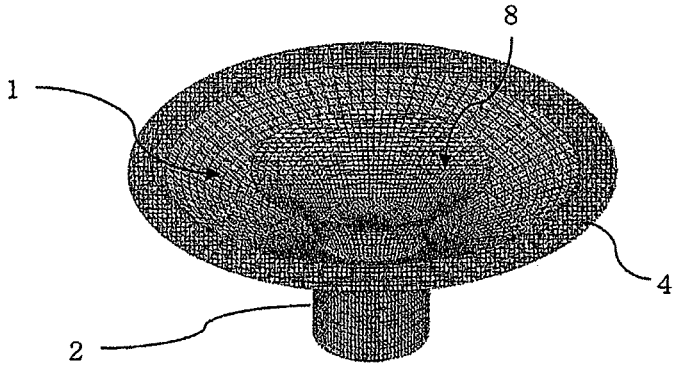
FIG. 2 is a perspective view for illustrating the configuration of the speaker according to the first embodiment.

A configuration of a speaker 100 according to a first embodiment of the present invention is described with reference to FIG. 1 and FIG. 2. FIG. 1 is a sectional view of the speaker 100. FIG. 2 is a perspective view of the speaker 100.

As illustrated in FIG. 1 and FIG. 2, in the speaker 100, an outer peripheral portion of a main-cone 1 is bonded to a frame 5 through a rolled edge 4 formed at an outer edge of the main-cone 1. A bobbin 2 is mounted to the main-cone 1, and a voice coil 3 is mounted around the bobbin 2. Further, a sub-cone 8 is mounted in a center of the main-cone 1. The voice coil 3 is adjusted so as to be positioned in a magnetic field 6 generated from a permanent magnet 7, which is fixed to the frame 5.

Figure 3:
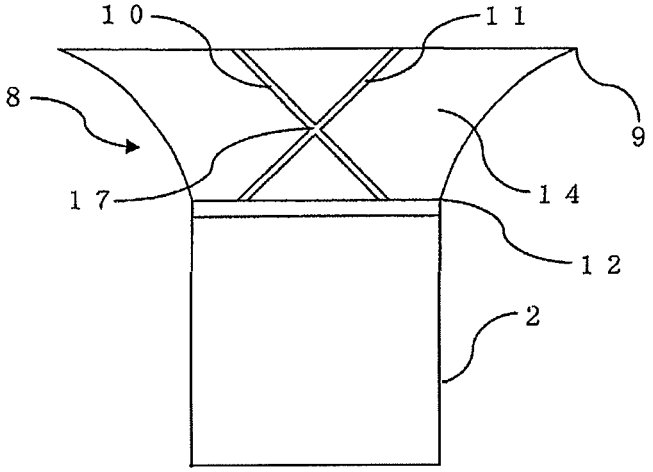
FIG. 3 is a side view for illustrating a shape of a sub-cone in the first embodiment.
Figure 4:
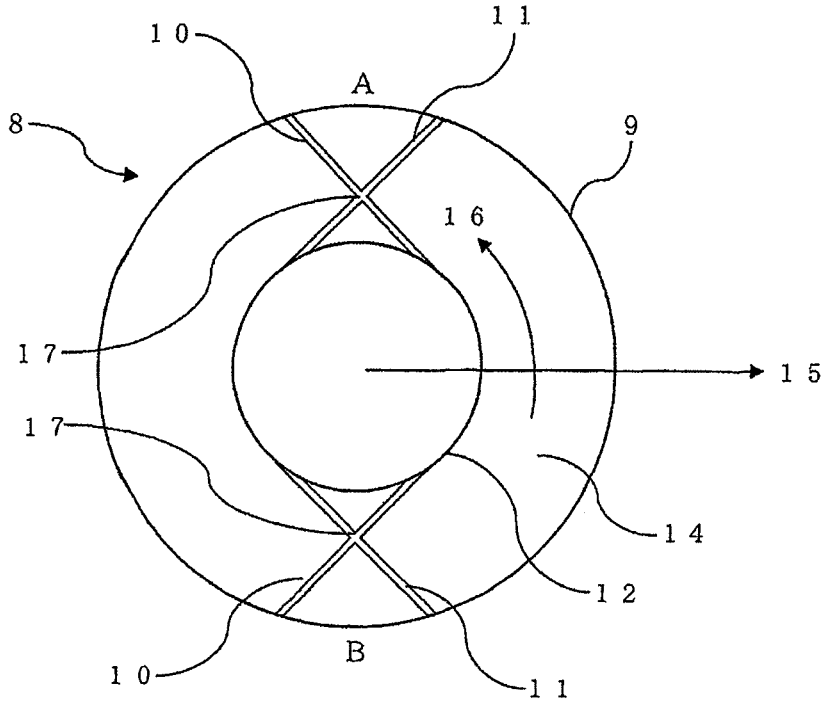
FIG. 4 is a bottom view for illustrating the shape of the sub-cone in the first embodiment.
Figure 5:
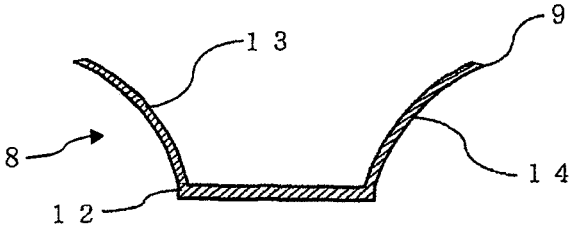
FIG. 5 is a sectional view of the sub-cone in the first embodiment.

Next, a shape of the sub-cone 8 is described with reference to FIG. 3 to FIG. 5. FIG. 3 is a front view for illustrating the shape of the sub-cone 8, and FIG. 4 is a bottom view for illustrating the shape of the sub-cone 8. FIG. 5 is a sectional view of the sub-cone 8, which is an illustration of a radiating surface of the sub-cone 8.

As illustrated in FIG. 3 to FIG. 5, on at least one of an outer side 14 and an inner side 13 of the sub-cone 8, linear thin portions 10 and 11 are formed so as to reduce a plate thickness of the sub-cone 8. Each of the linear thin portions 10 and 11 has both of a component in a radial direction 15 and a component in a circumferential direction 16 of the sub-cone 8. Each of the linear thin portions 10 and a corresponding one of the linear thin portions 11 cross each other at an intersection 17. The component of each of the linear thin portions 10 and 11 in the radial direction 15 contains a positive component and a negative component based on the intersection 17 as a starting point. A magnitude of the component of each of the linear thin portions 10 and 11 in the circumferential direction 16 is constant.

Figure 6:
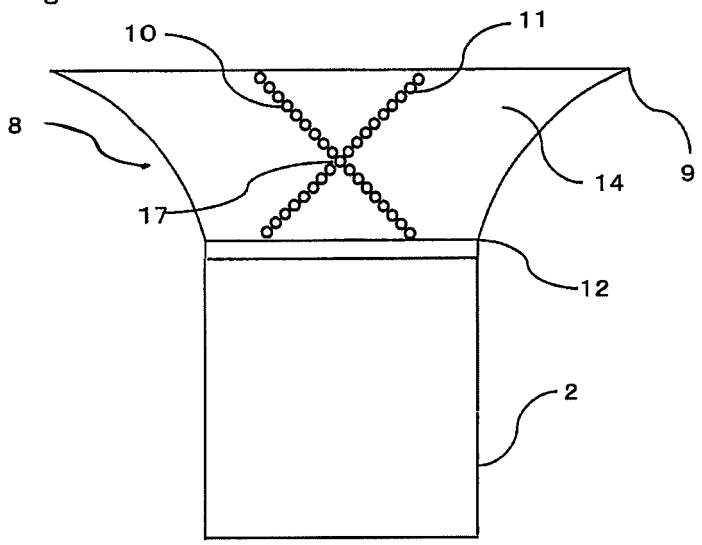
FIG. 6 is a bottom view for illustrating the shape of the sub-cone in the first embodiment.
Figure 7:
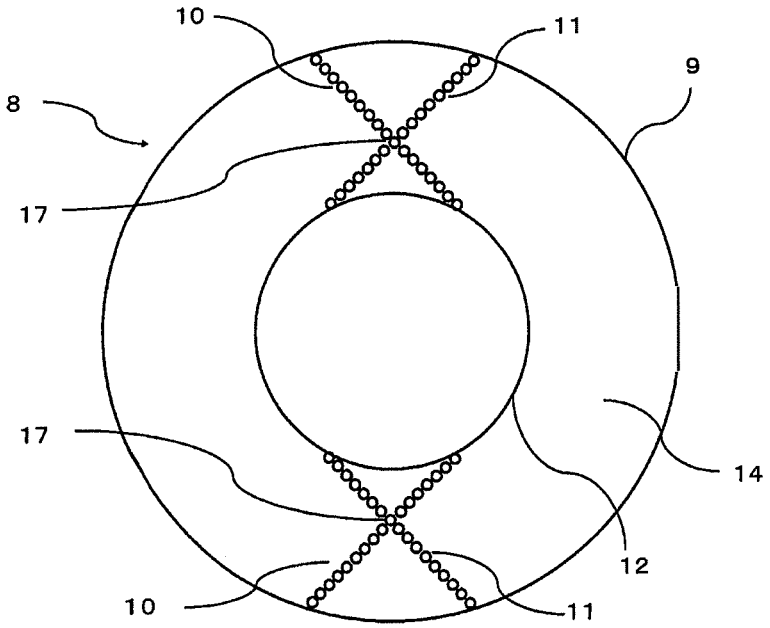
FIG. 7 is a sectional view of the sub-cone in the first embodiment.

As illustrated in FIG. 6 and FIG. 7, each of the linear thin portions 10 and 11 is not required to be formed continuously and may be formed by linearly arranging thin portions in a row. In FIG. 6 and FIG. 7, circular thin portions are linearly arranged in a row. However, a shape of each of the thin portions is not limited to the circular shape.

Figure 8:
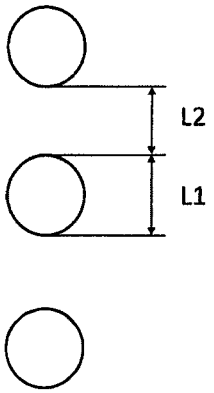
FIG. 8 is a bottom view of the sub-cone, for illustrating arrangement of thin portions of the sub-cone in a row in the first embodiment.

Further, as illustrated in FIG. 8, if an interval L2 between the thin portions is twice or larger than a maximum width L1 of each of the thin portions, a reduction in stiffness, which is sufficient to enhance a divided vibration, is not expected. Therefore, it is desired that the interval L2 be twice or smaller than the maximum width L1.

Figure 9A:
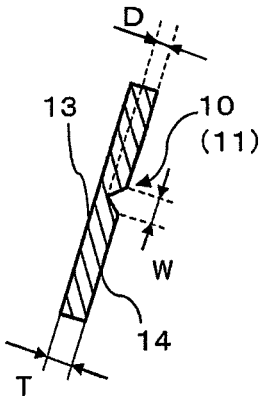
FIGS. 9A to 9C are views for illustrating various sectional shapes of a linear thin portion of the sub-cone in the first embodiment.
Figure 9B:
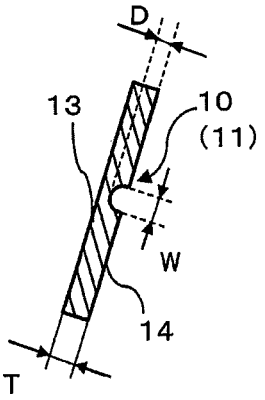
Figure 9C:
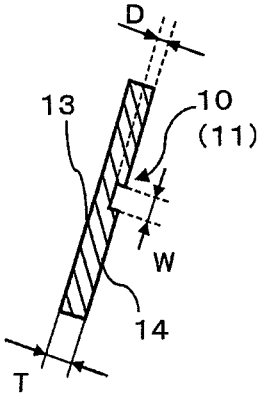

As illustrated in FIG. 9A to FIG. 9C, each of the linear thin portions 10 and 11 has a plate thickness T, a depth D and a width W as constituent elements of a sectional shape thereof. The depth D is about 15% to 35% of the plate thickness T. It is desired that the width W be 3.5% or smaller of a total length of an outer peripheral portion 9 of the sub-cone 8.

The depth D and the width W are not required to be constant. The width W may be changed at a suitable position in each of the linear thin portions 10 and 11.

As illustrated in FIG. 9A to FIG. 9C, various shapes such as a triangle (FIG. 9A), a semi-ellipsoid or a semi-circle (FIG. 9B) and a rectangle (FIG. 9C) are conceivable as the sectional shape of each of the linear thin portions 10 and 11. However, the sectional shape of each of the linear thin portions 10 and 11 is not limited to those exemplified above.

Figure 10:
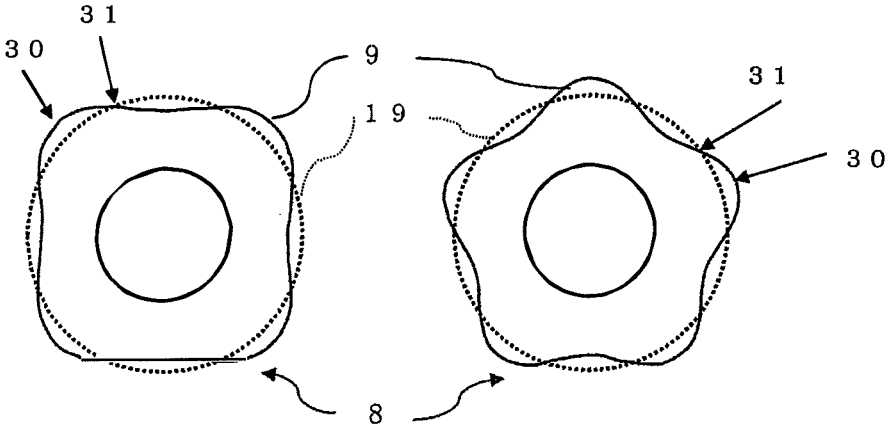
FIG. 10 is a top view for illustrating the shape of the sub-cone in the first embodiment at the time of a divided vibration.
Figure 11:
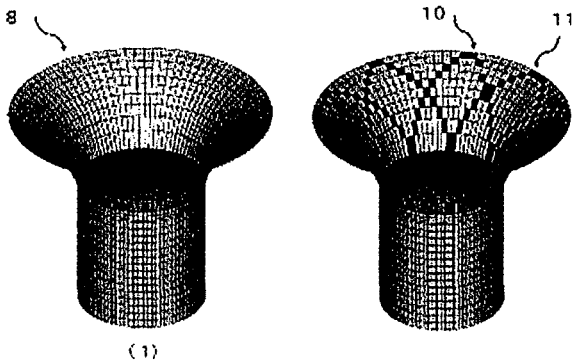
FIG. 11 is a perspective view of analysis models of the sub-cone, which are created to verify effects of the present invention.

In FIG. 10 and FIG. 11, the linear thin portions 10 and 11 are bilaterally symmetric in the radial direction 15 of the sub-cone 8 with respect to the intersection 17. However, the linear thin portions 10 and 11 are not necessarily required to be bilaterally symmetric. Therefore, magnitudes of the components of the linear thin portions 10 and 11 in the circumferential direction 16 are not particularly limited. The magnitude of the component of the linear thin portion 10 in the circumferential direction 16 and the magnitude of the component of the linear thin portion 11 in the circumferential direction 16 may be different from each other.

The linear thin portions 10 and 11 are not necessarily required to reach the outer peripheral portion 9 and an inner peripheral portion 12 of the sub-cone 8. Further, in FIG. 4, a set of the linear thin portions 10 and 11 on one side A and a set of the linear thin portions 10 and 11 on another side B are formed at positions so as to form an angle of 180 degrees in the circumferential direction 16 of the sub-cone 8. However, the positions of the linear thin portions 10 and 11 are not necessarily limited thereto. Specifically, the suitable number of sets of the linear thin portions 10 and 11 may be formed at positions so as to form a suitable angle in the circumferential direction 16 of the sub-cone 8.

Now, functions of the speaker 100 according to the first embodiment of the present invention are described.

As illustrated in FIG. 1, the parts 1, 2 and 3 are mounted to the frame 5 of the speaker 100 in order of the main cone 1, the bobbin 2 and the voice coil 3, with use of the rolled edge 4 as a spring.

As described above, the voice coil 3 is adjusted so as to be positioned in the magnetic field 6 generated from the permanent magnet 7. Therefore, when a current flows through the voice coil 3, a force is generated. The force is transmitted to the main-cone 1 and the sub-cone 8 through the bobbin 2. As a result, the bobbin 2, the main-cone 1 and the sub-cone 8 are moved integrally. At this time, the sub-cone 8 performs a vibrational behavior called a "divided vibration". FIG. 10 is a top view of the sub-cone 8 at the time of the divided vibration. As illustrated in FIG. 10, at the time of the divided vibration, the sub-cone 8 is deformed so as to be polygonally divided. This phenomenon occurs because of expansion and contraction of the sub-cone 8 in the radial direction 15 and the circumferential direction 16.

As illustrated in FIG. 1, unlike the main-cone 1, the sub-cone 8 is not fixed to the frame 5. The permanent magnet 7, the voice coil 3 and the bobbin 2 are designed based on an assumption that the main-cone 1 is driven thereby. Therefore, it is difficult for the sub-cone 8 to perform piston movement for reciprocating in a driving direction. Thus, the sub-cone 8 radiates a sound through the divided vibration.

Therefore, as illustrated in FIG. 3 and FIG. 4, the linear thin portions 10 and 11, each having both of the component in the radial direction 15 and the component in the circumferential direction 16 of the sub-cone 8, are formed so that a plate thickness of regions corresponding to the linear thin portions 10 and 11 is reduced to decease stiffness of the whole sub-cone 8 and stiffness of the linear thin portions 10 and 11. Thus, the sub-cone 8 becomes easily expandable and contractable in the radial direction 15 and the circumferential direction 16. Hence, the sub-cone 8 becomes easily deformable into the polygonal shape. Therefore, the divided vibration of the sub-cone 8 is enhanced to enable increase an acoustic radiation power of the sub-cone 8.

The radiation of a sound from the sub-cone 8 is dominant on a surface of the sub-cone 8 in the vicinity of the outer peripheral portion 9, and contribution to the radiation of the sound becomes smaller in a direction toward the inner peripheral portion 12. Therefore, the acoustic radiation power of the sub-cone 8 can be increased by increasing a deformation amount of the surface of the sub-cone 8 in the vicinity of the outer peripheral portion 9. The deformation amount of the surface of the sub-cone 8 in the vicinity of the outer peripheral portion 9 can be increased by, for example, as illustrated in FIG. 3 and FIG. 4, forming a surface surrounded by the outer peripheral portion 9 of the sub-cone 8 and the linear thin portions 10 and 11.

For the formation of the surface described above, two or more linear thin portions are required to be formed as represented by the linear thin portions 10 and 11. The linear thin portions 10 and 11 are formed to have the intersection 17.

FIG. 11 is a perspective view of analysis models of the sub-cone 8, which are created to verify effects of the present invention. In FIG. 11, a model (1) does not have linear thin portions, and a model (2) has linear thin portions. Black regions represent the thin portions.

Figure 12:
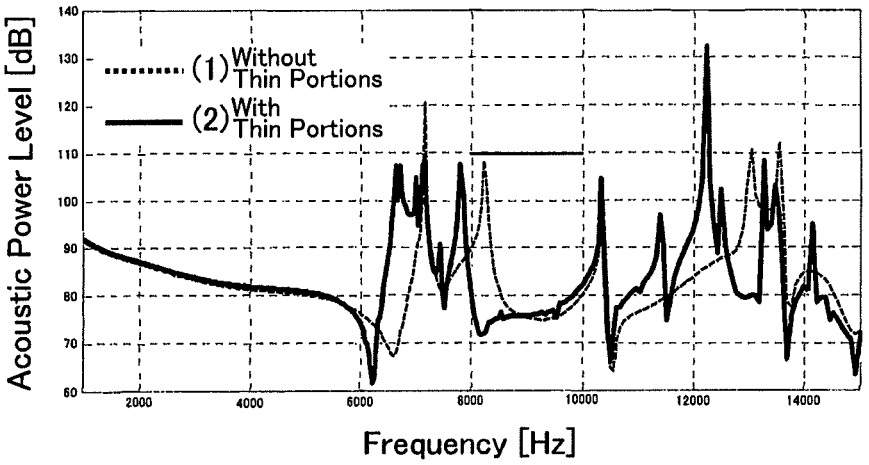
FIG. 12 is a graph for showing frequency characteristics of acoustic power levels obtained from the analysis models of the sub-cone, which are created to verify the effects of the present invention.

A vibration analysis and an acoustic analysis for the sub-cone 8 were carried out with use of the models described above so as to obtain acoustic power levels of the radiated sounds from the sub-cone 8. FIG. 12 is a graph for showing frequency characteristics of the acoustic power levels of the sub-cone 8, which are obtained from the vibration analysis and the acoustic analysis.

As shown in FIG. 12, with the model (2) having the linear thin portions, the acoustic power level in a range of from 10 kHz to 12.5 kHz is higher than that with the model (1) without linear thin portions. The reason is as follows. As a result of the formation of the linear thin portions 10 and 11 on the sub-cone 8, the divided vibration occurs with the linear thin portions 10 and 11 functioning as nodes.

Further, in a range of from 1 kHz to 15 kHz, a frequency range in which the model (2) having the linear thin portions has a higher acoustic power level than that of the model (1) without linear thin portions is wide. Thus, the acoustic radiation power is large over a wide frequency range. Therefore, effectiveness of the formation of the linear thin portions 10 and 11 on the sub-cone 8 can be confirmed.

At the frequency in a range of from 7.8 kHz to 9 kHz, the model (1) without linear thin portions has a larger average velocity at the outer peripheral portion of the sub-cone than an average velocity of the model (2) having the linear thin portions. However, the average velocity of the model (2) having the linear thin portions at the frequency in the range of from 7.8 kHz to 9 kHz can be made higher than that of the model (1) without linear thin portions by changing the shapes and the number of linear thin portions.

Next, the reason why it is desired that the depth D of each of the thin portions be set to fall within a range of from 15% to 35% of the plate thickness T is described based on a result of analysis.

Figure 13:
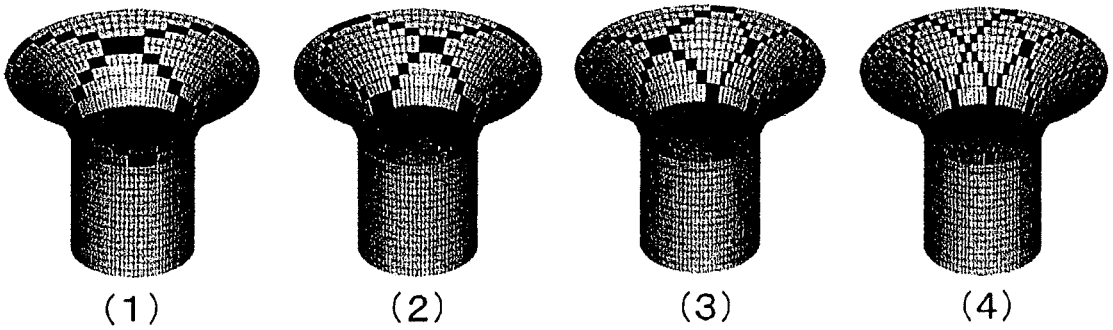
FIG. 13 is a perspective view of analysis models of the sub-cone, which are created to verify effects of a depth of each of the thin portions.

FIG. 13 is a perspective view of analysis models of the sub-cone 8, which are created to verify effects of the depth D of each of the thin portions. In FIG. 13, an analysis model (1) has six linear thin portions, an analysis model (2) has eight linear thin portions, an analysis model (3) has ten linear thin portions, and an analysis model (4) has eighteen linear thin portions. Black regions represent the thin portions. A thickness of the thin portions of these four analysis models described above was changed by 10% for each time within a range of from 10% to 60% so as to compare overall values of the acoustic power levels.

Figure 14:
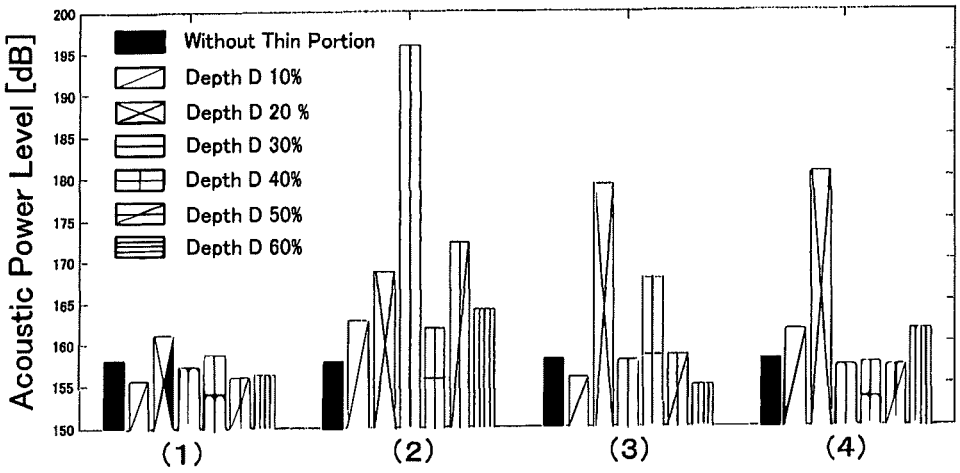
FIG. 14 is a graph for showing overall values of acoustic power levels of the analysis models of the sub-cone, which are created to verify the effects of the depth of each of the thin portions.

FIG. 14 is a graph for showing the overall values of the acoustic power levels of the radiated sounds from the sub-cone 8, which are obtained from the vibration analysis and the acoustic analysis with use of the analysis models of FIG. 13. The vertical axis indicates the overall value of the acoustic power level, whereas the horizontal axis indicates the number of the analysis model of FIG. 13. As shown in FIG. 14, the following is understood. In the analysis models (1) to (4), when the depth D of each of the thin portions is 20% or 30% of the plate thickness T, the acoustic power level becomes maximum. When the depth D is set larger than 30%, the acoustic power level is gradually decreased. Based on the tendency of the result of the analysis, it is understood that the thin portions configured to enhance the divided vibration have maximum effects when the depth D of each of the thin portions falls within the range of from 15% to 35% of the plate thickness T.

Subsequently, how the width W is desired to be 3.5% or smaller of the total length of the outer peripheral portion 9 of the sub-cone 8 is described.

Figure 15:
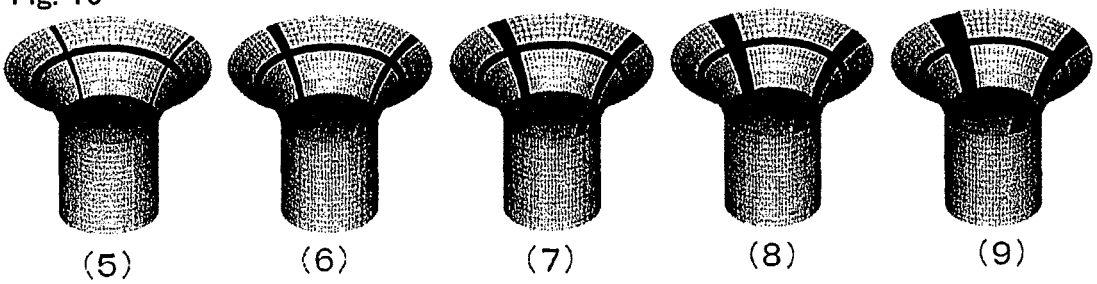
FIG. 15 is a perspective view of analysis models of the sub-cone, which are created to verify effects of a width of each of the thin portions.

FIG. 15 is a perspective view of analysis models of the sub-cone 8, which are created to verify effects of the width W of each of the thin portions. In FIG. 15, an analysis model (5) has the linear thin portions, each having the width W and only the component in the radial direction 15, in which the width W is 1% of the total length of the outer peripheral portion 9 of the sub-cone 8, an analysis model (6) has the linear thin portions, each having the width W and only the component in the radial direction 15, in which the width W is 2% of the total length of the outer peripheral portion 9 of the sub-cone 8, an analysis model (7) has the linear thin portions, each having the width W and only the component in the radial direction 15, in which the width W is 3% of the total length of the outer peripheral portion 9 of the sub-cone 8, an analysis model (8) has the linear thin portions, each having the width W and only the component in the radial direction 15, in which the width W is 4% of the total length of the outer peripheral portion 9 of the sub-cone 8, and an analysis model (9) has the linear thin portions, each having the width W and only the component in the radial direction 15, in which the width W is 5% of the total length of the outer peripheral portion 9 of the sub-cone 8. Black regions represent the thin portions. The overall values of the acoustic power levels were compared to each other with use of the analysis models described above.

Figure 16:
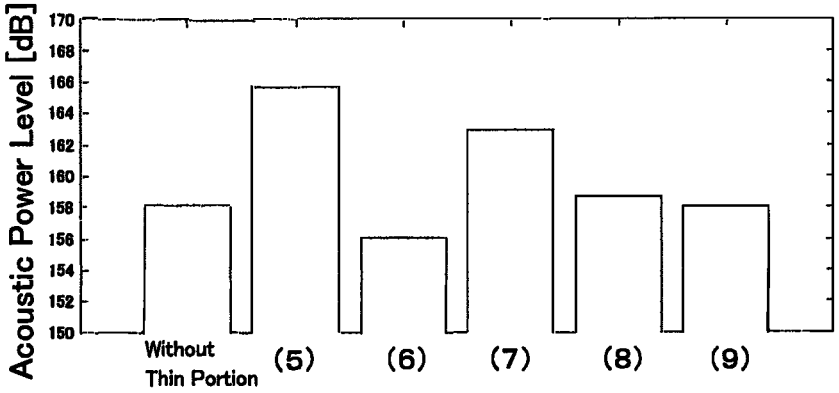
FIG. 16 is a graph for showing overall values of acoustic power levels of the analysis models of the sub-cone, which are created to verify the effects of the width of each of the thin portions.

FIG. 16 is a graph for showing the overall values of the acoustic power levels of the radiated sounds from the sub-cone 8, which are obtained from the vibration analysis and the acoustic analysis with use of the analysis models of FIG. 15. The vertical axis indicates the overall value of the acoustic power level, whereas the horizontal axis indicates the number of the analysis model of FIG. 15. As shown in FIG. 16, when the width W of each of the thin portions becomes larger than 30%, the result becomes closer to the result with the analysis model without thin portions. Based on the tendency of the result of the analysis described above, the following is understood. It is desired that the width W of each of the thin portions configured to enhance the divided vibration be 3.5% or smaller of the total length of the outer peripheral portion 9 of the sub-cone 8.

Subsequently, when a position of the outer peripheral portion 9 of the sub-cone 8 is defined as 100% in the radial direction 15 based on the inner peripheral portion 12 of the sub-cone 8 as a base point, the position of the intersection 17 with which the divided vibration is enhanced was analyzed and verified.

Figure 17:
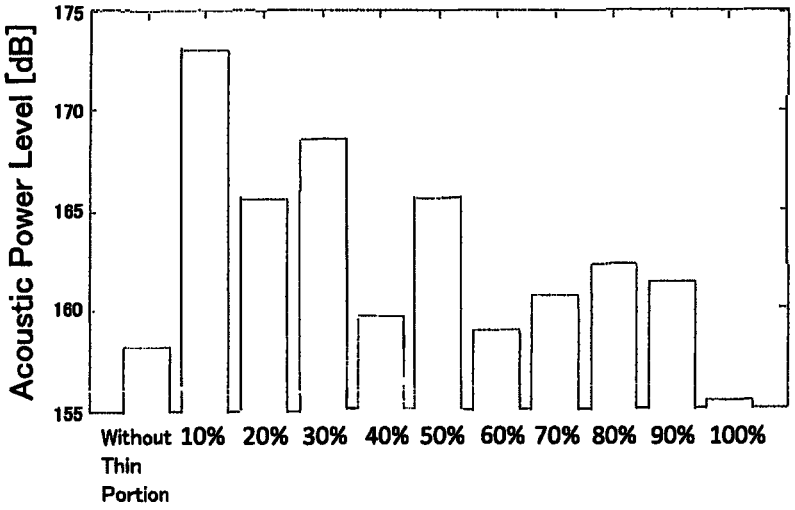
FIG. 17 is a graph for showing overall values of the acoustic power levels of the analysis models of the sub-cone, which are created to verify effects of a position of an intersection between the thin portions.

In FIG. 17, comparison between results of analysis of the acoustic power levels with use of the analysis model (1) illustrated in FIG. 15 is shown as an example. In the analysis model, when the position of the outer peripheral portion 9 of the sub-cone 8 is defined as 100% in the radial direction 15 based on the inner peripheral portion 12 of the sub-cone 8 as the base point, the position of the intersection 17 between the thin portions, each having 0 as the component in the radial direction 15 and 360 degrees as the component in the radial direction 16, was changed by 10% for each time in the radial direction 15.

As described above, by forming the surface surrounded by two or more linear thin portions 10 and 11 and the outer peripheral portion 9 of the sub-cone 8, the deformation amount of the surface is increased. Therefore, it is considered that, as the intersection 17 is positioned closer to the outer peripheral portion 9, the acoustic power level becomes closer to the acoustic power level of the sub-cone 8 without the linear thin portions 10 and 11.

As shown in FIG. 17, in the analysis model verified in the analysis described above, the position of the outer peripheral portion 9 of the sub-cone 8 is defined as 100% in the radial direction 15 based on the inner peripheral portion 12 of the sub-cone 8 as the base point. In this case, when the intersection 17 is located at a position larger than 50%, the acoustic power level becomes closer to the result of the analysis model without thin portions. Based on the tendency of the result of the analysis, it is understood that, by forming the surface surrounded by the two or more linear thin portions 10 and 11 and the outer peripheral portion 9 of the sub-cone 8, the deformation amount of the surface is increased.

A vibration shape of the divided vibration differs depending on, for example, a sectional shape of the sub-cone 8. Therefore, the portion at which the intersection is required to be formed changes. However, in general, the vibration shape of the divided vibration is deformed into the polygonal shape. Therefore, when the vibration shape of the divided vibration is an N-sided polygon as illustrated in FIG. 17, 2N nodes 31, which are undeformable, and 2N anti-nodes 30, which are largely deformable, are present in the circumferential direction 16. On a straight line that connects the node 31 or the anti-node 30 and a center of the outer peripheral portion 9 of the sub-cone 8, an expansion and contraction distribution of the sub-cone 8 is scarcely different between the N-sided polygon and an (N+1)-sided polygon. Therefore, from the result of FIG. 17, it is considered that it is desired that the intersection closest to the inner peripheral portion 12 of the sub-cone 8 be positioned at 55% or smaller.

As described above, in the speaker 100 according to the first embodiment of the present invention, the plurality of linear thin portions 10 and 11 are formed on the sub-cone 8. These linear thin portions 10 and 11 have the intersection 17 on the sub-cone 8. With the configuration described above, the plate thickness of the regions corresponding to the linear thin portions 10 and 11 is reduced to decrease the stiffness of the whole sub-cone 8. Thus, the divided vibration of the sub-cone 8 is enhanced. In particular, the vibrational displacement of the outer peripheral portion 9 of the sub-cone 8, from which a sound is mainly radiated, is increased.

Further, the sub-cone 8 does not have a corrugation like the one described in Patent Literature 2. Therefore, the stiffness of the sub-cone 8 is not increased. Thus, deformation of the outer peripheral portion 9 of the sub-cone 8 at the time of the divided vibration is not suppressed. Further, unlike in Patent Literature 1, a radiation area of the sub-cone 8 is not reduced. Thus, as shown in FIG. 12, a sound pressure that is necessary to compensate for a high-frequency band unreproducible with the main-cone 1 can be obtained with the sub-cone 8. Therefore, a reproducible frequency band for the speaker 100 can be enlarged while the acoustic radiation power can be increased.

Second Embodiment

Figure 18:
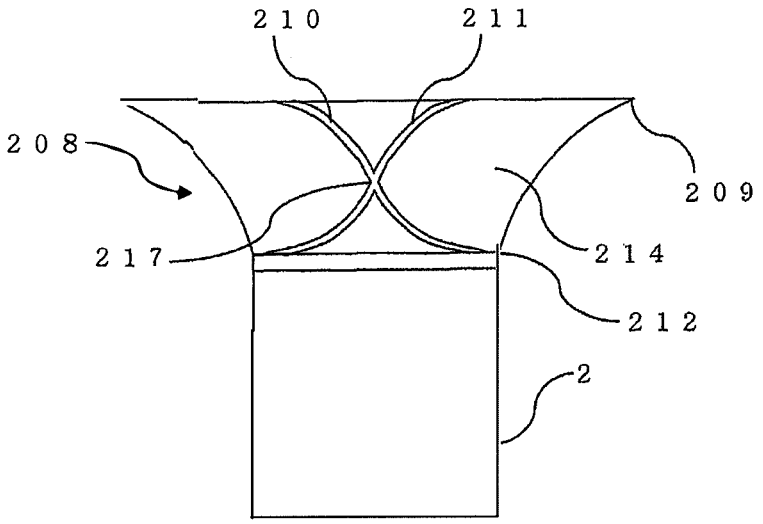
FIG. 18 is a front view for illustrating a shape of a sub-cone in a second embodiment.

Next, a configuration of a sub-cone 208 in a second embodiment of the present invention is described with reference to FIG. 18 and FIG. 19. FIG. 18 is a front view for illustrating a shape of the sub-cone 208, and FIG. 19 is a bottom view for illustrating the shape of the sub-cone 208.

Figure 19:
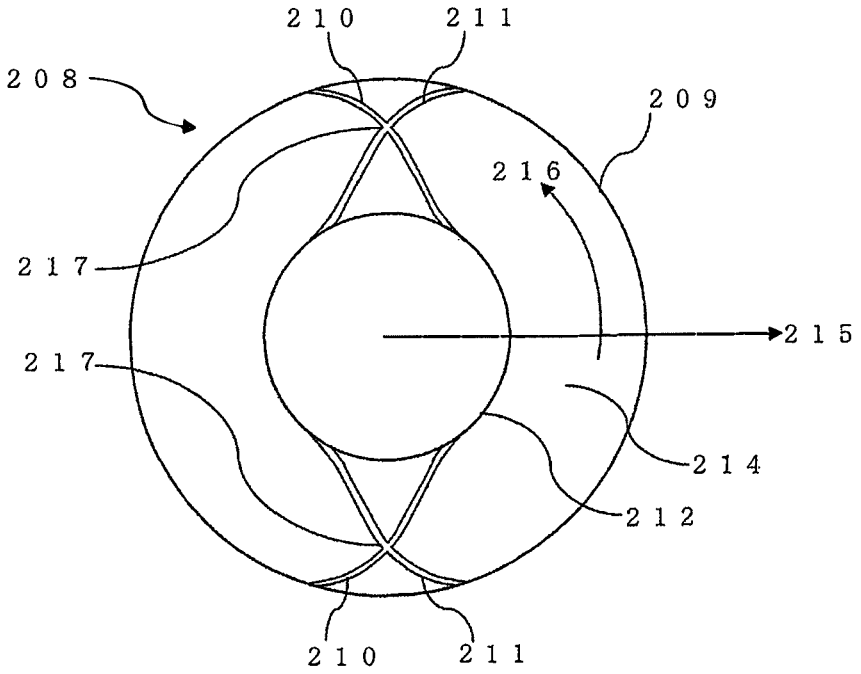
FIG. 19 is a bottom view for illustrating the shape of the sub-cone in the second embodiment.

As illustrated in FIG. 18 and FIG. 19, each of linear thin portions 210 and 211 formed on the sub-cone 208 in the second embodiment has both of a component in a radial direction 215 and a component in a circumferential direction 216 of the sub-cone 208. However, in contrast to the first embodiment, a magnitude of the component of each of the linear thin portions 210 and 211 in the circumferential direction 216 is not constant. Each of the linear thin portions 210 and 211 is formed as a smooth curve extending in the radial direction 215 of the sub-cone 208. The component of each of the linear thin portions 210 and 211 in the radial direction 215 contains a positive component and a negative component based on an intersection 217 as a starting point. Even with the configuration described above, the same effects as those obtained in the first embodiment can be obtained.

Third Embodiment

Figure 20:
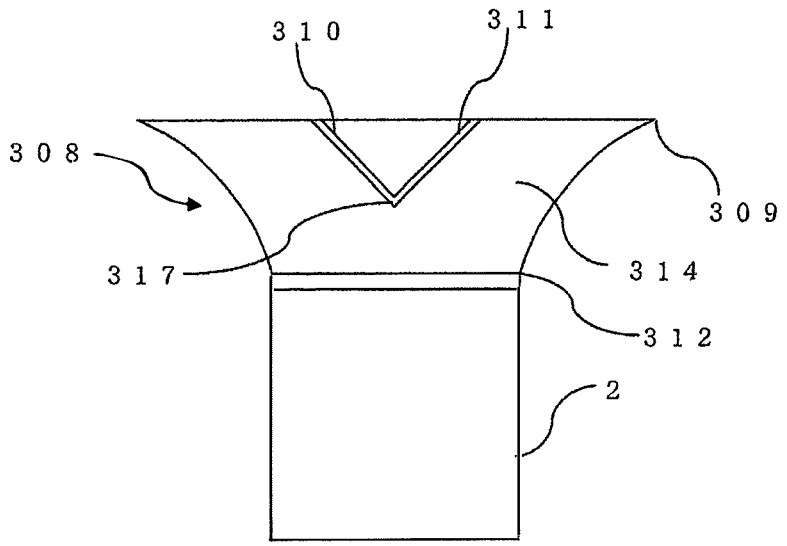
FIG. 20 is a front view for illustrating a shape of a sub-cone in a third embodiment.

Next, a configuration of a sub-cone 308 in a third embodiment of the present invention is described with reference to FIG. 20 and FIG. 21. FIG. 20 is a front view for illustrating a shape of the sub-cone 308, and FIG. 21 is a bottom view for illustrating the shape of the sub-cone 308.

Figure 21:
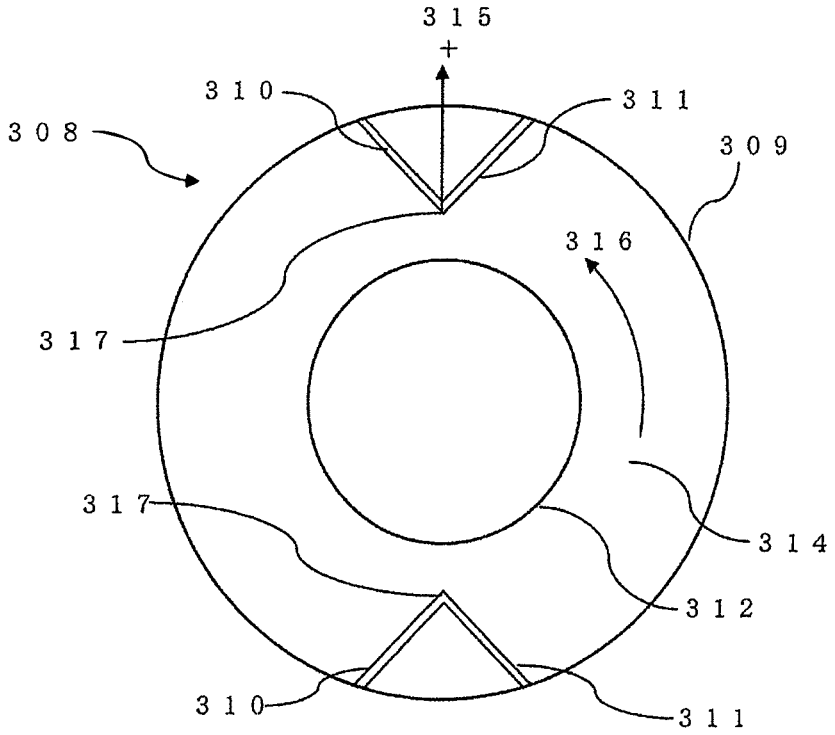
FIG. 21 is a bottom view for illustrating the shape of the sub-cone in the third embodiment.

As illustrated in FIG. 20 and FIG. 21, a magnitude of a component of each of linear thin portions 310 and 311 formed on the sub-cone 308 in the third embodiment in a circumferential direction 316 is constant. However, in contrast to the first embodiment, a component of each of the linear thin portions 310 and 311 in the radial direction 315 contains only a positive component based on an intersection 317 as a starting point. Even with the configuration described above, the same effects as those obtained in the first and second embodiments can be obtained.

Fourth Embodiment

Figure 22:
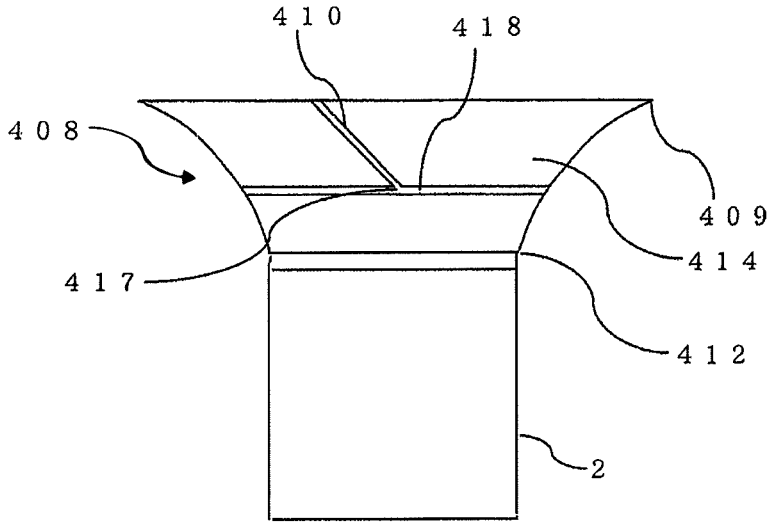
FIG. 22 is a front view for illustrating a shape of a sub-cone in a fourth embodiment.

Next, a configuration of a sub-cone 408 in a fourth embodiment of the present invention is described with reference to FIG. 22 and FIG. 23. FIG. 22 is a front view for illustrating a shape of the sub-cone 408, and FIG. 23 is a bottom view for illustrating the shape of the sub-cone 408.

Figure 23:
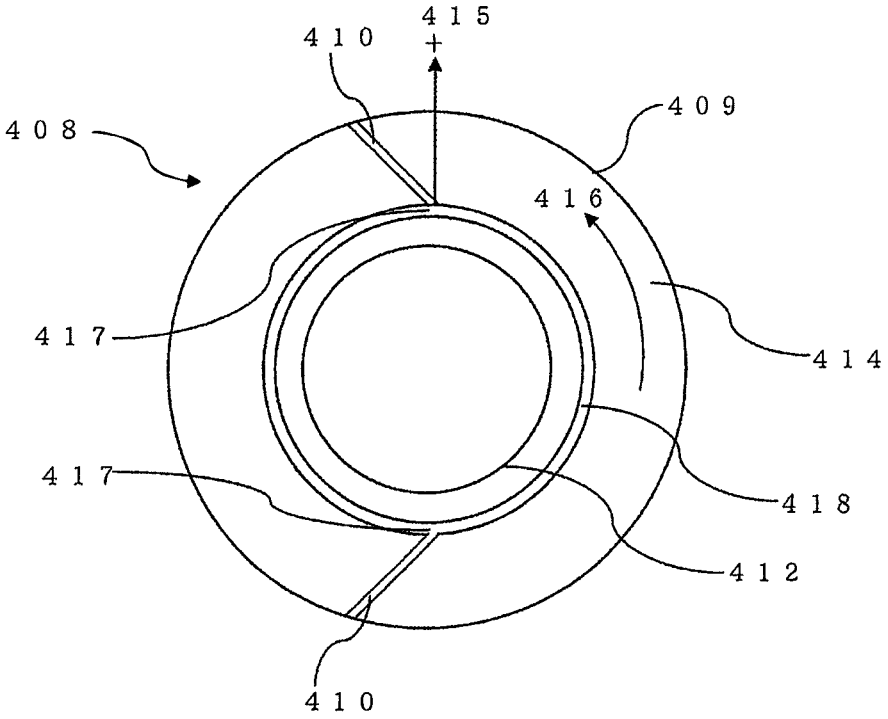
FIG. 23 is a bottom view for illustrating the shape of the sub-cone in the fourth embodiment.

As illustrated in FIG. 22 and FIG. 23, linear thin portions 410 and 418 formed on the sub-cone 408 in the fourth embodiment correspond to a first linear thin portion 410 and a second linear thin portion 418. The first linear thin portion 410 has both of a component in a radial direction 415 and a component in a circumferential direction 416 of the sub-cone 408. The second linear thin portion 418 has only a component in the circumferential direction 416 of the sub-cone 408. The second linear thin portion 418 may also be formed to have only a component in the radial direction 415 of the sub-cone 408. Specifically, the second linear thin portion 418 in the fourth embodiment is formed to have only any one of the component in the radial direction 415 and the component in the circumferential direction 416 of the sub-cone 408. Even with the configuration described above, the same effects as those obtained in the first to third embodiments can be obtained.

In FIG. 22 and FIG. 23, the component of the second linear thin portion 418 in the circumferential direction 416 extends from 0 degrees to 360 degrees. However, the range of the component in the circumferential direction 416 is not limited thereto and may suitably be set. Further, the number of second linear thin portions 418 is not limited to one and may be the suitable number.

Further, the first linear thin portion 410 may be formed as a smooth curve extending in the radial direction 415 of the sub-cone 408, as in the second embodiment. Further, the component of the first linear thin portion 410 in the radial direction 415 may contain only a positive component based on the intersection 417 as a starting point, as in the third embodiment.

The invention claimed is:

1. A speaker, comprising:

a main-cone; and a sub-cone, wherein a first linear thin portion and a second linear thin portion that reduce a thickness of the sub-cone are formed on the sub-cone, the first linear thin portion and the second linear thin portion have an intersection on a surface of the sub-cone, wherein a depth of each of the first linear thin portion and the second linear thin portion is 35% of a plate thickness of the sub-cone or smaller.

2. The speaker according to claim 1, wherein a magnitude of a component in a circumferential direction of each of the first linear thin portion and the second linear thin portion is constant.

3. The speaker according to claim 1, wherein the first linear thin portion and the second linear thin portion are formed as a smooth curve extending in a radial direction.

4. The speaker according to claim 1, wherein each of a component in a radial direction of the first linear thin portion and the second linear thin portion has only a positive component in the radial direction based on the intersection as a starting point.

5. The speaker according to claim 1, wherein the second linear thin portion has only any one of a component in a radial direction and a component in a circumferential direction.

6. The speaker according to claim 1, further comprising a surface surrounded by the first linear thin portion and the second linear thin portion and an outer peripheral portion of the sub-cone.

7. The speaker according to claim 1, wherein a depth of each of the first linear thin portion and the second linear thin portion falls within a range of from 15% to 35% of a plate thickness of the sub-cone.

8. A speaker, comprising:

a main-cone; and a sub-cone, wherein a first linear thin portion and a second linear thin portion are formed on the sub-cone, and the first linear thin portion and the second linear thin portion have an intersection on the sub-cone, wherein a width of each of the first linear thin portion and the second linear thin portion is 3.5% or smaller of a total length of an outer peripheral portion of the sub-cone.

9. A speaker, comprising:

a main-code; and a sub-cone, wherein a first linear thin portion and a second linear thin portion that reduce a thickness of the sub-cone are formed on the sub-cone, the first linear thin portion and the second linear thin portion have an intersection on a surface of the sub-cone, wherein, when a position of an outer peripheral portion of the sub-cone is defined as 100% in a radial direction based on an inner peripheral portion of the sub-cone as a base point, the intersection between the first linear thin portion and the second linear thin portion is positioned at 55% or smaller.

10. The speaker according to claim 1, further comprising a surface surrounded by the first linear thin portion and the second linear thin portion and an outer peripheral portion of the sub-cone, wherein a depth of each of the first linear thin portion and the second linear thin portion falls within a range of from 15% to 35% of a plate thickness of the sub-cone, wherein a width of each of the first linear thin portion and the second linear thin portion is 3.5% or smaller of a total length of the outer peripheral portion of the sub-cone, and wherein, when a position of the outer peripheral portion of the sub-cone is defined as 100% in a radial direction based on an inner peripheral portion of the sub-cone as a base point, the intersection between the first linear thin portion and the second linear thin portion is positioned at 55% or smaller.

11. The speaker according to claim 1, wherein at least one of the first linear thin portion and the second linear thin portion is not formed continuously.

12. The speaker according to claim 1, wherein at least one of the first linear thin portion and the second linear thin portion includes a plurality of discrete thin portions that are not connected to each other.

13. The speaker according to claim 12, wherein each of the plurality of discrete thin portions has a maximum width L1 and is separated by an interval L2, where the interval L2 is twice or smaller than the maximum width L1.

14. The speaker according to claim 1, wherein at least one of the first linear thin portion and the second linear thin portion extends from the intersection only towards an outer radial portion of the sub-cone.

15. The speaker according to claim 1, wherein at least one of a component in a radial direction of the first linear thin portion and a component in the radial direction of the second linear thin portion has only a positive component in the radial direction based on the intersection as a starting point.

* * * * *